US007391392B2

(12) United States Patent
Yahagi

(10) Patent No.: US 7,391,392 B2
(45) Date of Patent: Jun. 24, 2008

(54) METHOD AND DEVICE FOR DRIVING DISPLAY PANEL UNIT

(75) Inventor: Kazuo Yahagi, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 654 days.

(21) Appl. No.: 11/072,295

(22) Filed: Mar. 7, 2005

(65) Prior Publication Data

US 2005/0195133 A1 Sep. 8, 2005

(30) Foreign Application Priority Data

Mar. 8, 2004 (JP) ..... 2004-063930

(51) Int. Cl.
*G09G 3/28* (2006.01)

(52) U.S. Cl. ..... 345/63; 315/169.4

(58) Field of Classification Search ..... 345/60–72, 345/76–83; 315/169.1–169.4
See application file for complete search history.

(56) References Cited

U.S. PATENT DOCUMENTS 6,271,812 B1 * 8/2001 Osada et al. ..... 345/76
6,985,126 B2 * 1/2006 Hoppenbrouwers et al. ... 345/60
7,176,856 B2 * 2/2007 Yahagi et al. ..... 345/68
7,199,770 B2 * 4/2007 Okuda ..... 345/82

FOREIGN PATENT DOCUMENTS

JP 2001-312244 11/2001

* cited by examiner

*Primary Examiner*—Alexander Eisen
*Assistant Examiner*—Benjamin Jeffers
(74) *Attorney, Agent, or Firm*—Finnegan. Henderson. Farabow, Garrett & Dunner, L.L.P.

(57) ABSTRACT

Only when an input image signal continues to indicate a black display for a predetermined period of time or longer, some pixel cells randomly selected from among all pixel cells on a display screen are forcibly set to a light-emitting mode in an address process of a subfield with a small weighting.

12 Claims, 8 Drawing Sheets

FIG.3

| GRADATION | PIXEL DRIVE DATA GD | | | | | | | | | | | | LIGHT EMISSION PATTERN | | | | | | | | | | |
|---|---|---|---|---|---|---|---|---|---|---|---|---|---|---|---|---|---|---|---|---|---|---|---|
| | 1 | 2 | 3 | 4 | 5 | 6 | ------ | N-4 | N-3 | N-2 | N-1 | N | SF 1 | SF 2 | SF 3 | SF 4 | SF 5 | ------ | SF N-4 | SF N-3 | SF N-2 | SF N-1 | SF N |
| 1 | 0 | 0 | 0 | 0 | 0 | 0 | | 0 | 0 | 0 | 0 | 0 | | | | | | | | | | | |
| 2 | 1 | 0 | 0 | 0 | 0 | 0 | | 0 | 0 | 0 | 0 | 0 | ○ | | | | | | | | | | |
| 3 | 0 | 1 | 0 | 0 | 0 | 0 | ------ | 0 | 0 | 0 | 0 | 0 | | ○ | | | | | | | | | |
| 4 | 1 | 1 | 0 | 0 | 0 | 0 | | 0 | 0 | 0 | 0 | 0 | ○ | ○ | | | | | | | | | |
| 5 | 0 | 0 | 1 | 0 | 0 | 0 | | 0 | 0 | 0 | 0 | 0 | | | ○ | | | | | | | | |
| ⋮ | | | ⋮ | | | | | | | ⋮ | | | | ⋮ | | | | | | | | | |
| $2^N-5$ | 0 | 1 | 0 | 1 | 1 | 1 | | 1 | 1 | 1 | 1 | 1 | | ○ | | ○ | ○ | | ○ | ○ | ○ | ○ | ○ |
| $2^N-4$ | 1 | 1 | 0 | 1 | 1 | 1 | | 1 | 1 | 1 | 1 | 1 | ○ | ○ | | ○ | ○ | | ○ | ○ | ○ | ○ | ○ |
| $2^N-3$ | 0 | 0 | 1 | 1 | 1 | 1 | ------ | 1 | 1 | 1 | 1 | 1 | | | ○ | ○ | ○ | ------ | ○ | ○ | ○ | ○ | ○ |
| $2^N-2$ | 1 | 0 | 1 | 1 | 1 | 1 | | 1 | 1 | 1 | 1 | 1 | ○ | | ○ | ○ | ○ | | ○ | ○ | ○ | ○ | ○ |
| $2^N-1$ | 0 | 1 | 1 | 1 | 1 | 1 | | 1 | 1 | 1 | 1 | 1 | | ○ | ○ | ○ | ○ | | ○ | ○ | ○ | ○ | ○ |
| $2^N$ | 1 | 1 | 1 | 1 | 1 | 1 | | 1 | 1 | 1 | 1 | 1 | ○ | ○ | ○ | ○ | ○ | | ○ | ○ | ○ | ○ | ○ |

○: SELECTIVE-WRITING ADDRESS
DISCHARGE + SUSTAIN-DISCHARGE LIGHT EMISSION

FIG.6

| GRADATION | PIXEL DRIVE DATA GD | | | | | | | | | | | | LIGHT EMISSION PATTERN | | | | | | | | | | |
|---|---|---|---|---|---|---|---|---|---|---|---|---|---|---|---|---|---|---|---|---|---|---|---|
| | 1 | 2 | 3 | 4 | 5 | 6 | ------ | N-4 | N-3 | N-2 | N-1 | N | SF 1 | SF 2 | SF 3 | SF 4 | SF 5 | ------ | SF N-4 | SF N-3 | SF N-2 | SF N-1 | SF N |
| 1 | 0 | 0 | 0 | 0 | 0 | 0 | | 0 | 0 | 0 | 0 | 0 | | | | | | | | | | | |
| 2 | 1 | 1 | 0 | 0 | 0 | 0 | | 0 | 0 | 0 | 0 | 0 | ◎ | ● | | | | | | | | | |
| 3 | 1 | 0 | 1 | 0 | 0 | 0 | ------ | 0 | 0 | 0 | 0 | 0 | ◎ | ○ | ● | | | | | | | | |
| 4 | 1 | 0 | 0 | 1 | 0 | 0 | | 0 | 0 | 0 | 0 | 0 | ◎ | ○ | ○ | ● | | | | | | | |
| 5 | 1 | 0 | 0 | 0 | 1 | 0 | | 0 | 0 | 0 | 0 | 0 | ◎ | ○ | ○ | ○ | ● | | | | | | |
| ⋮ | | | ⋮ | | | | | | | ⋮ | | | | | ⋮ | | | | | | | | |
| N-4 | 1 | 0 | 0 | 0 | 0 | 0 | | 1 | 0 | 0 | 0 | 0 | ◎ | ○ | ○ | ○ | ○ | | ● | | | | |
| N-3 | 1 | 0 | 0 | 0 | 0 | 0 | | 0 | 1 | 0 | 0 | 0 | ◎ | ○ | ○ | ○ | ○ | | ○ | ● | | | |
| N-2 | 1 | 0 | 0 | 0 | 0 | 0 | | 0 | 0 | 1 | 0 | 0 | ◎ | ○ | ○ | ○ | ○ | | ○ | ○ | ● | | |
| N-1 | 1 | 0 | 0 | 0 | 0 | 0 | ------ | 0 | 0 | 0 | 1 | 0 | ◎ | ○ | ○ | ○ | ○ | ------ | ○ | ○ | ○ | ● | |
| N | 1 | 0 | 0 | 0 | 0 | 0 | | 0 | 0 | 0 | 0 | 1 | ◎ | ○ | ○ | ○ | ○ | | ○ | ○ | ○ | ○ | ● |
| N+1 | 1 | 0 | 0 | 0 | 0 | 0 | | 0 | 0 | 0 | 0 | 0 | ◎ | ○ | ○ | ○ | ○ | | ○ | ○ | ○ | ○ | ○ |

SELECTIVE-WRITING ADDRESS

◎ : DISCHARGE + SUSTAIN-DISCHARGE LIGHT EMISSION

○ : SUSTAIN-DISCHARGE LIGHT EMISSION

● : SELECTIVE-ELIMINATION ADDRESS DISCHARGE

METHOD AND DEVICE FOR DRIVING DISPLAY PANEL UNIT

BACKGROUND OF THE INVENTION

1. Field of the Invention

The present invention relates to a drive method and a drive device for a display panel unit that displays images.

2. Description of the Related Art

At present AC-type (alternating current discharge type) plasma display panels are increasingly used in commercial products as thin or flat display devices. The discharge cells in a plasma display panel correspond to pixels of images to be displayed, and emit light using the discharge phenomenon. This means that each discharge cell has only two levels: a light-emitting state corresponding to the highest brightness level and a lights out state corresponding to the lowest brightness level. Grayscale driving using subfields is therefore used in plasma display panels of this type in order to achieve intermediate levels of display brightness faithful to the input image signal.

In grayscale driving based on the subfield method, each field for image signal is divided into a plurality of subfields, each subfield is assigned its own light-emission repetition number (how many times the subfield concerned emits light or how long the subfield emits light), and display driving is carried out for such one field worth of image signal. An address process and a sustain process are carried out successively within each subfield. During the address process, selective discharge takes place within each discharge cell, in response to the input image signal, so as to form a wall charge of a specified amount (or to eliminate the wall charge). During the sustain process, only those cells in which the specified amount of wall charge has been formed are repeatedly discharged, so as to maintain light emission that goes with that discharge. At least within the leading subfield, a preliminary formatting process (initialization process) precedes the address process. The preliminary formatting process resets all the discharge cells at once by causing discharge in all the discharge cells (called "reset discharge"), thereby forming a specified amount of wall charge within all the discharge cells (or eliminating a wall charge from all the discharge cells).

Because this reset discharge is produced in all discharge cells independently of the content of the image to be displayed, the light emission caused by this discharge tends to lower the contrast of the image.

Japanese Patent Kokai (Laid-open Application) No. 2001-312244 discloses a drive method in which no reset discharge for preliminary formatting purposes is carried out on discharge cells which emit light at 0-level brightness. In this drive method, selective discharge is produced for each discharge cell that is to emit light, in the address process of each subfield. By producing a specified amount of wall charge within the discharge cells in this selective discharge, these discharge cells become ready for discharge in the subsequent sustain process.

However, when 0-level brightness continues within a discharge cell for a long period of time, the wall charge remaining inside that discharge cell gradually decreases under the influence of dark current and other factors, so that even if selective discharge takes place in this discharge cell during a later address process, the amount of wall charge formed will not reach the specified (desired) value. As a result, there is a risk with this method that some discharge cells might not discharge as they ought to during the sustain process, and that an incorrect or inadequate image might be created.

SUMMARY OF THE INVENTION

It is one purpose of the present invention to provide a drive method for a plasma display panel that can improve contrast without causing any decline in picture quality.

Another purpose of the present invention to provide a drive device for a plasma display panel that can improve contrast without causing any decline in picture quality.

According to a first aspect of the present invention, there is provided an improved method for driving a display panel. The display panel has a plurality of pixel cells, which serve as pixels. The pixel cells are arranged in a matrix pattern. The display panel is driven for each of a plurality of subfields that make up each field of an input image signal, to carry out grayscale display. Each subfield has its own weighting. Each subfield includes an address process in which each of the pixel cells within each subfield is set to either light-emitting mode or lights out mode based on the input image signal. The method includes a sustain process that causes only those pixel cells which are set to the light-emitting mode to emit light for a duration of a period corresponding to the weighting of the subfield concerned. Pixel cells selected at random from among all the pixel cells are forcibly set to the light-emitting mode during the address process of a subfield having a small weighting only when the input image signal continues to indicate a black display for a predetermined period of time or longer.

According to a second aspect of the present invention, there is provided another drive method for a display panel. The display panel includes a plurality of pixel cells, which serve as pixels. The pixel cells are arranged in a matrix pattern. The display panel is driven for each of a plurality of subfields that make up each field of an input image signal, to carry out grayscale display. Each subfield has its own weighting. Pixel data are prepared from the input image signal. Each subfield includes an address process for setting each pixel cell to either a light-emitting mode or a lights out mode in accordance with the logic level of the pixel data of each pixel at the bit digit corresponding to the subfield concerned. The drive method has a sustain process for causing only those pixel cells set to the light-emitting mode to emit light for a period of time corresponding to the weighting of the subfield concerned. The result of a logical addition of the data bit of the pixel data at the bit digit corresponding to the subfield having small weighting and an overhead bit having a logic level to set pixel cells randomly selected from among all the pixel cells to the light-emitting mode is made a new data bit of the pixel data at the above mentioned bit digit.

According to a third aspect of the present invention, there is provided an improved device for driving a display panel. The display panel has a plurality of pixel cells which serve as pixels. The pixel cells are arranged in a matrix pattern. The display panel is driven for each of a plurality of subfields that define each field of an input image signal, to carry out grayscale display. Each subfield has its own weighting. The drive device includes an address circuit for setting each of the pixel cells to either a light-emitting mode or a lights out mode based on the input image signal in each of the subfields. The drive device also includes a sustain circuit for causing only those pixel cells set to the light-emitting mode to emit light for a period corresponding to the weighting of the subfield concerned, in the subfield concerned. In a subfield having a small weighting, some pixel cells are selected at random from among all the pixel cells and are forcibly set to the light-emitting mode by the address circuit only when the input image signal continues to indicate a black display for a predetermined period of time or longer.

According to a fourth aspect of the present invention, there is provided another drive device for a display panel. The display panel includes a plurality of pixel cells which function as pixels. The pixel cells are arranged in a matrix pattern, and the display panel is driven for each of a plurality of subfields that make up each field of an input image signal, to carry out grayscale display. Each subfield has its own weighting. The drive device includes an address circuit for setting each of the pixel cells to either a light-emitting mode or a lights out mode based on the input image signal within each of the subfields. The drive device also includes a sustain circuit for causing only those pixels cells set to the light-emitting mode to emit light for a period corresponding to the weighting of the subfield concerned. The drive device also includes an overhead bit generator for generating an overhead bit having a logic level to set to the light-emitting mode the pixel cells selected at random from among all the pixel cells. The drive device also includes a logical adder for making the result of a logical addition of the data bit of the pixel data at the bit digit corresponding to the subfield having the small weighting and the overhead bit, a new data bit of the pixel data at the above mentioned bit digit.

BRIEF DESCRIPTION OF THE DRAWINGS

FIG. 3 shows pixel drive data generated by a pixel drive data generating circuit and the light-emission pattern within one field (frame) when carrying out driving according to the light-emission drive sequence shown in FIG. 2;

FIG. 6 shows the pixel drive data generated within the pixel drive data generating circuit and the light-emission pattern within one field (frame) when driving is carried out according to the light-emission drive sequence shown in FIG. 5;

DETAILED DESCRIPTION OF THE INVENTION

Figure 1:
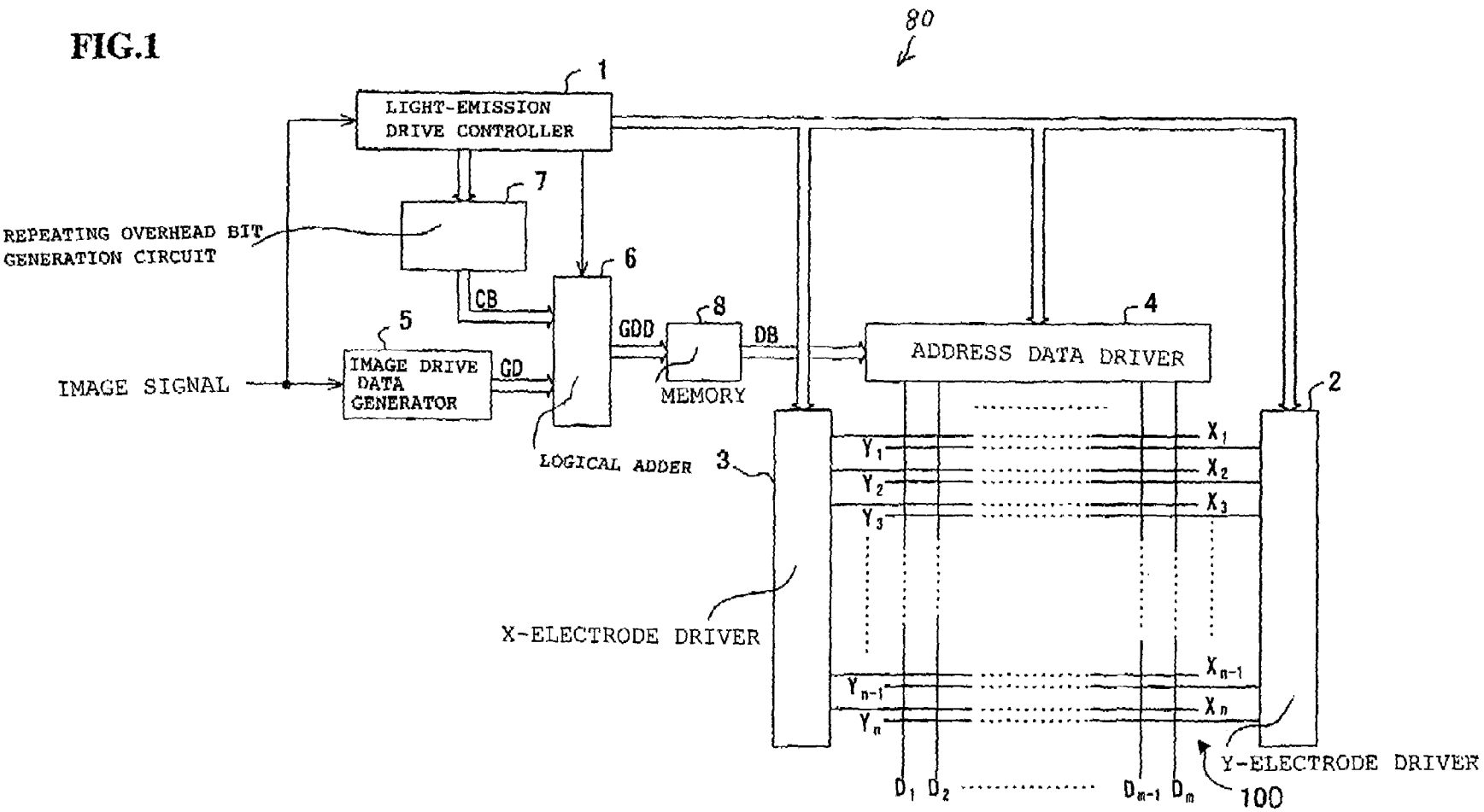
FIG. 1 shows the outline composition of a plasma display device arrangement that carries out grayscale driving in a plasma display panel based on the drive method according to the present invention.

Referring to FIG. 1, the outline composition of a plasma display device 80 will be described. This plasma display device 80 is operated by a grayscale driving scheme. A drive method according to the present invention is applied to the plasma display device 80. The plasma display device 80 includes a plasma display panel (PDP) 100, and three electrode drivers 2, 3 and 4 to drive three types of electrodes of the plasma display panel 100. The electrode drivers 2, 3 and 4 are connected to a light-emission control circuit 1.

As shown in FIG. 1, the plasma display panel 100 has a front transparent base or substrate (not shown) on which n row electrodes $X_1$-$X_n$ and n row electrodes $Y_1$-$Y_n$ are alternately arranged and a rear base or substrate (not shown) on which m column electrodes $D_1$-$D_m$ are disposed as address electrodes. A pair of adjacent row electrodes $X_i$, $Y_i$ makes up one display line of the PDP 100. That is to say, the row electrodes $X_1$-$X_n$ and the row electrodes $Y_1$-$Y_n$ form the first to n-th display lines of the PDP 100. A discharge space into which a discharge gas is inserted is formed between the front transparent substrate and the rear substrate, and a pixel cell that serves as pixel is formed at each point of interstice between the row electrode pairs and the column electrodes including the discharge space. In other words, within the PDP 100, pixel cells that function as pixels are arranged on a matrix made up of n rows by m columns.

Figure 2:
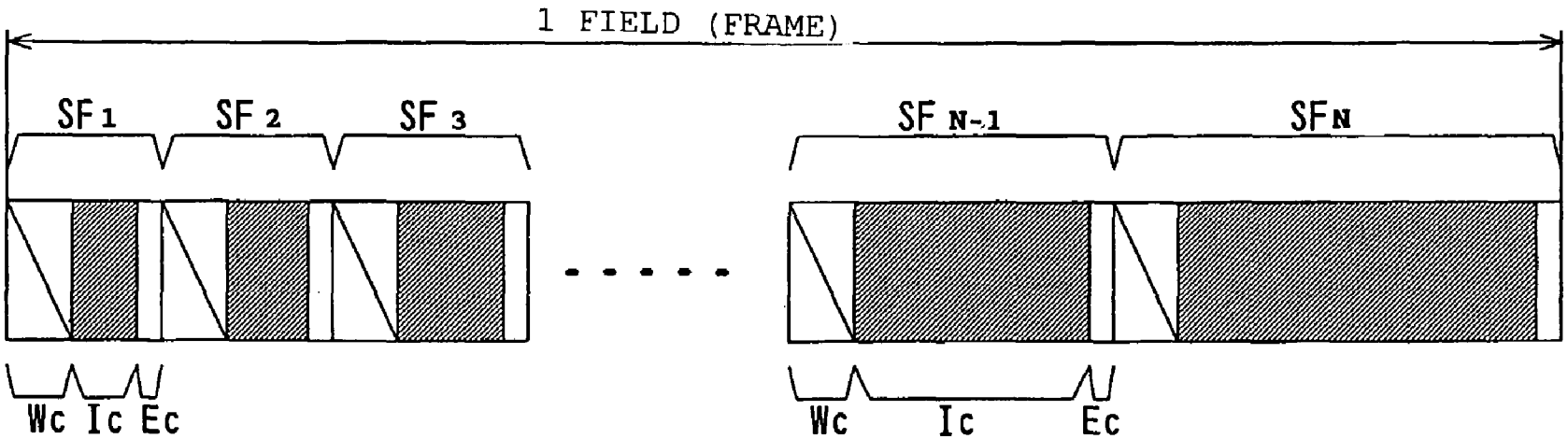
FIG. 2 shows an example of a light-emission drive sequence as employed for the plasma display device shown in FIG. 1.

The light-emission control circuit 1 controls the Y-electrode driver 2, the X-electrode driver 3, and an address data driver 4 in response to the input image signal, in order to control the light emission within the PDP 100 in accordance with a light emission driving sequence employing the subfield method such as that shown in FIG. 2.

It should be noted that in the light-emission drive sequence shown in FIG. 2, each field (or frame) of the image signal includes N subfields $SF_1$-$SF_N$. Each subfield has its own weighting. Each subfield SF has a selective-writing address process Wc, a sustain process Ic, and an elimination process Ec. During the selective-writing address process Wc in each of the subfields $SF_1$-$SF_N$, each pixel cell is set either to 'light-emitting model' or 'lights out mode' in accordance with the pixel drive data bit DB (described below) associated with the subfield in question. For the sustain process Ic in each of the subfields $SF_1$-$SF_N$, a light-emission repetition number (emission period), determined on the basis of the weighting of the subfield in question, is assigned to that subfield. In the example shown in FIG. 2, within the subfields $SF_1$-$SF_N$, the subfield $SF_1$ has the smallest weighting, and the weighting of each subfield increases with the value of the number attached to it. During the sustain process Ic, only those pixel cells that have been set to 'light-emitting mode' are caused to emit light repeatedly, until they have completed the number of repetitions assigned by the light emitting repetition number. During the extinguishing process Ec for each of the subfields $SF_1$-$SF_N$, pixel cells set to the 'light-emitting mode' are switched to the 'lights out mode'.

The pixel driving data generating circuit 5 can generate $2^N$ pixel driving data GD of N bits in accordance with brightness levels of the input image signal as shown in FIG. 3, and supply the pixel driving data GD to the logical addition circuit 6. It should be noted that the first bit to Nth bit of the pixel drive data GD correspond to the first subfield $SF_1$to Nth subfield $SF_N$, respectively (i.e., the bit digit of the pixel drive data corresponds to the subfield number), and specify whether the pixel cell is set to the light-emitting mode or the lights out mode during the selective-writing address process of the subfield concerned. In FIG. 3, if a bit of the pixel drive data GD is at logic level 1, then during the selective-writing address process Wc of the subfield corresponding to that bit, the pixel cell is set to the light-emitting mode, whereas if the bit is at logic level 0 the pixel cell is set to the lights out mode. For example, as shown in FIG. 3, in response to an image signal of brightness level 0, the pixel drive data generating circuit 5 generates pixel drive data GD whose first to Nth bits are all at logic level 0. In this case, the pixel cell is set to the lights out state over all the subfields $SF_1$-$SF_N$. As a result, this pixel cell maintains a lights out state during one field (frame) and a black display is created. Likewise, as shown in FIG. 3, in response to an image signal of brightness level 5, the pixel drive data generation circuit 5 generates pixel drive data GD whose first and third bits are at logic level 1 and other bits are at logic level 0. In this case, the pixel cell is set to the light-emitting mode during the selective-writing address process Wc in the subfields $SF_1$ and $SF_3$ only. As a result, within this pixel cell sustain discharge takes place during the sustain process Ic only in the two subfields $SF_1$ and $SF_3$ within the range of the subfields $SF_1$-$SF_N$. Consequently, an image of brightness level 5 is detected (perceived) corresponding to the total number of repetitions of sustain discharge in the subfields $SF_1$ and $SF_3$.

The repeating overhead bit generating circuit 7 first generates an overhead bit CB at logic level 1 that sets each of a plurality of pixel cells chosen at random from among all the pixel cells within a single screen to the light-emitting mode, and generates an overhead bit CB at logic level 0 that maintains all the other pixel cells in their current state (light-emitting mode or lights out mode). For example, the repeating overhead bit generating circuit 7 generates a one-bit overhead bit CB as shown in the first bit pattern in FIG. 4A for each of the pixel cells within a screen (image). Next, the repeating overhead bit generating circuit 7 generates an overhead bit CB at logic level 1 to set to light-emitting mode each of a plurality of cells chosen at random from among those pixel cells that are not switched to light-emitting mode in the first bit pattern, and an overhead bit CB at logic level 0 to maintain all the other pixel cells in their present state. For example, the repeating overhead bit generating circuit 7 generates an 1-bit overhead bit CB as shown in the second bit pattern in FIG. 4B for each of the pixel cells within a single screen. Next, the repeating overhead bit generating circuit 7 generates an overhead bit CB at logic level 1 in order to set to light-emitting mode all those pixel cells that are not set to light-emitting mode in the first and second bit patterns. For all the remaining pixel cells the repeating overhead bit generating circuit 7 generates an overhead bit CB at logic level 0 to maintain them in their present state. For example, the repeating overhead bit generating circuit 7 generates a one-bit overhead bit CB for each of the pixel cells within a single screen as shown by the third bit pattern in FIG. 4C.

Figures 4A, 4B, 4C:
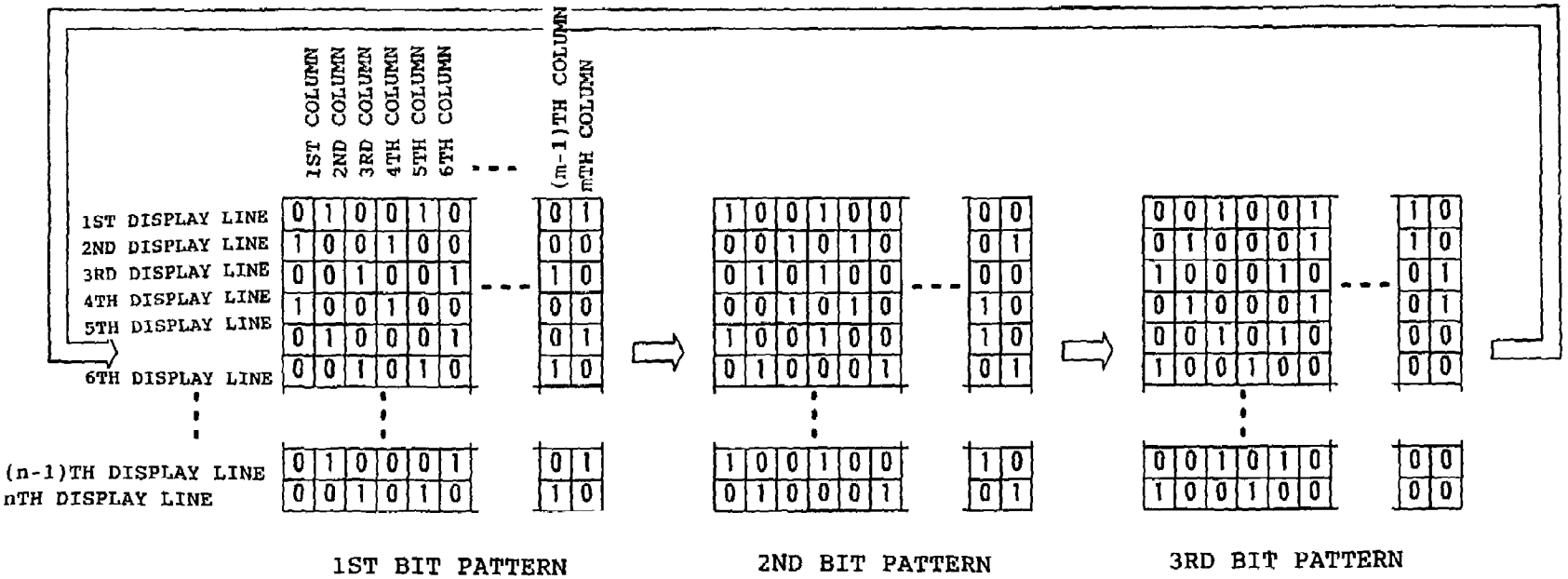
FIG. 4A shows a first bit pattern of overhead bits generated by a repeating overhead bit generating circuit.
FIG. 4B shows a second bit pattern of the overhead bits generated by the repeating overhead bit generating circuit.
FIG. 4C shows a third bit pattern of the overhead bits generated by the repeating overhead bit generating circuit.

When the generation of overhead bits based on this third bit pattern has been completed, the repeating overhead bit generation circuit 7 starts to generate overhead bits CB based on the first bit pattern again, and carries out the above procedure repeatedly. That is to say, the repeating overhead bit generating circuit 7 carries out the overhead bit generating actions according to the first bit pattern shown in FIG. 4A, the second bit pattern as shown in FIG. 4B, and the third bit pattern shown in FIG. 4C sequentially and repetitively. Over the course of a single cycle of the first, second, and third bit patterns, the overhead bit CB to each pixel cell becomes the logic level 1 only once. For example, as shown in FIG. 4A to FIG. 4C, the overhead bit CB for the pixel cell at the second display line-second column is at logic level 0 in the first and second bit patterns but at logic level 1 in the third bit pattern. The repeating overhead bit generating circuit 7 switches from an overhead bit CB generating action based on the first (second, third) bit pattern to an overhead bit CB generating action based on the second (third, first) bit pattern for every k fields of the input image signal (where k is an integer no less than 1).

The repeating overhead bit generating circuit 7 then supplies the resulting overhead bits CB to the logical addition circuit 6.

The logical addition circuit 6 carries out a logical addition of the one-bit overhead bit CB provided for each pixel cell by the repeating overhead bit generating circuit 7 and the first bit of the N-bit pixel drive data GD of that pixel cell, and supplies N-bit pixel drive data GDD having the result of this logical addition as its new first bit to the memory 8. In other words, the logical addition circuit 6 carries out a logical addition by means of the overhead bit CB on the first bit of the pixel drive data GD of the subfield $SF_1$, which has the smallest weighting. The subfield $SF_1$ has the smallest weighting and has therefore been assigned the smallest number of light-emission repetitions (i.e., the shortest light-emission period). The logical addition circuit 6 uses the result of the logical addition as the first bit in the N-bit pixel drive data GDD.

This pixel drive data GDD is written in the memory 8 sequentially. When a single screen's worth of data has been written, i.e., when the writing of pixel drive data for the n×m pixel cells starting at the first row, first column and continuing to the n-th row, m-th column is completed, the memory 8 carries out the read-out action as described below.

Within the memory 8, the pixel drive data GD of each pixel cell within one screen's worth of image is divided by bit numbers or bit digits (from the first bit to the Nth bit) and the pixel drive data bits $DB_1$-$DB_N$ are obtained. The memory 8 then sequentially reads the pixel drive data bits DB1 of the respective pixel cells in the subfield $SF_1$ for one display line at a time, and provides them to the address data driver 4. Next, the memory 8 reads sequentially the pixel drive data bits DB2 of the pixel cells in the subfield $SF_2$ for one display line a time, and provides them to the address data driver 4. The memory 8 continues to read the pixel drive data bits $DB_3$, $DB_4$, $DB_5$, . . . , $DB_N$ in the same way during the address process Ic of each subfield $SF_3$, $SF_4$, $SF_5$, . . . , $SF_N$, for one display line a time, and provides them to the address data driver 4.

The Y-electrode driver 2 applies a scanning pulse sequentially to each of the row electrodes $Y_1$-$Y_n$ within the PDP 100 during the selective-writing address process Wc of each subfield SF. Meanwhile, the address data driver 4 generates m pixel data pulses $DP_1$-$DP_m$ having voltages respectively corresponding to the logic levels of the m pixel drive data bits DB of one display line provided by the memory 8, and applies the data pulses to the column electrodes $D_1$-$D_m$ within the PDP 100. For example, if the pixel drive data bit DB is at logic level 1, the address data driver 4 generates a pixel data pulse DP at a predetermined high voltage. The address data driver 4 generates a pixel data pulse DP at a predetermined low voltage (0 volts in this embodiment) if the pixel drive data bit DB is at logic level 0. Selective discharge (referred to as selective-writing discharge) takes place in those pixel cells to which the scanning pulse SP is applied and a high-voltage pixel data pulse DP is applied, so that a wall charge of a specified size is created within these pixel cells. In those pixel cells to which a low-voltage pixel data pulse DP is applied, however, the selective writing discharge does not take place, even though the scanning pulse SP is applied to such pixel cells. No wall charge is created in these pixel cells. Those pixel cells in which a wall charge of the specified level has been created are set to the 'light-emitting mode', while those pixel cells in which no wall charge has been created are set to the 'lights out mode'.

During the sustain process Ic of each subfield SF, the X-electrode driver 3 repeatedly applies a sustain pulse to each of the row electrodes $X_1$-$X_n$, within the PDP 100, the number of repetitions corresponding to the weighting of that subfield SF in question. At the same time the Y-electrode driver 2 repeatedly applies a sustain pulse to each of the row electrodes $Y_1$-$Y_n$ within the PDP 100, the number of repetitions corresponding to the weighting of the subfield SF in question. In the example shown in FIG. 2, of all the subfields $SF_1$-$SF_N$, it is the first subfield $SF_1$ that has the smallest weighting, and the weighting of each subfield increases as the number attached to the subfield rises. In other words, in the example shown in FIG. 2, of all the subfields $SF_1$-$SF_N$, the smallest number of sustain pulses is applied during the sustain process Ic of the subfield $SF_1$, while the number of sustain pulses applied during the sustain process Ic of the subfield $SF_N$ is the largest. Every time the sustain pulse is applied, pixel cells set to the light-emitting mode carry out discharge (referred to as sustain discharge), and maintain the light-emitting state that accompanies that discharge.

Consequently, by means of driving in response to the pixel drive data GDD derived from the $2^N$ pixel drive data GD as shown in FIG. 3, there are $2^N$ combination patterns of the subfields in which light-emission accompanying sustain discharge is triggered (shown in FIG. 3 by white circles) within one field (frame), as shown in FIG. 3. Accordingly, by means of this driving, a brightness can be expressed in $2^N$ ways, corresponding to the total number of repetitions of sustain discharge light-emission within one field (frame).

During the eliminating process Ec of each subfield SF, the X-electrode driver 3 applies an eliminating pulse of a relatively short pulse width to all the row electrodes $X_1$-$X_n$, simultaneously. In this way, eliminating discharge takes place within those pixel cells that are set to the light emitting mode so that the wall charge left behind in those pixel cells is eliminated.

The following description deals with an example where the repeating overhead bit generating circuit 7 changes the bit patterns for each field from FIG. 4A to FIG. 4C and generates overhead bits CB based on these bit patterns.

First, within the first field, a logical addition is carried out on the first bit of the pixel drive data GD of each pixel cell and the overhead bit CB based on the first bit pattern as shown in FIG. 4A. The pixel drive data GDD is produced having the result of this logical addition as its new first bit. Consequently, by means of driving according to this pixel drive data GDD, within the subfield $SF_1$, pixel cells corresponding to the overhead bit CB at logic level 1 in FIG. 4A are set to the light-emitting mode and perform sustain-discharge regardless of the input image signal.

Next, in the second field, a logical addition is carried out between the first bit of the pixel drive data GD of each pixel cell and the overhead bit CB based on the second bit pattern as shown in FIG. 4B, and the pixel drive data GDD having the result of this logical addition as its new first bit is generated. Thus, by means of driving according to this pixel drive data GDD, within the subfield $SF_1$, pixel cells corresponding to an overhead bit CB at logic level 1 in FIG. 4B are set to the light-emitting mode and perform sustain-discharge regardless of the input image signal.

Next, in the third field, a logical addition is carried out between the first bit of the pixel drive data GD of each pixel cell and the overhead bit CB based on the third bit pattern as shown in FIG. 4C, and the pixel drive data GDD having the result of this logical addition as its new first bit is generated. Thus, by driving according to this pixel drive data GDD, within the subfield $SF_1$, pixel cells corresponding to an overhead bit CB at logic level 1 in FIG. 4C are set to the light-emitting mode and perform sustain-discharge regardless of the input image signal.

Over the course of one cycle of data generation from the first to third bit patterns, the overhead bit CB corresponding to each of the pixel cells becomes at logic level 1 only once.

In other words, all the pixel cells carry out sustain discharge at least once within the subfield $SF_1$ in the course of progressing through the three fields as described above, regardless of the input image signal. Consequently, even if an input image signal of brightness level 0 representing a black display is entered consistently over a long period of time, all the pixel cells discharge at least once within the three fields, so that the decrease of the wall charge remaining inside each pixel cell is kept (reduced) under control. Furthermore, because the pixel cells discharge in a time-divided manner (i.e., some pixel cells are forced to discharge in the first field, some pixel cells are forced to discharge in the second field and some pixel cells are forced to discharge in the third field), it is possible to limit the deterioration in contrast compared to that which can occur when all the discharge cells are discharged at the same time as in simultaneous reset discharge.

Consequently, even if a video image signal of brightness level 0 for a black display is supplied to the display device over a long period of time, the decrease in wall charge is limited and a correct selective-discharge is triggered. As a result, it is possible to improve contrast without causing any deterioration in picture quality.

It should be noted that although in the above described embodiment the repeating overhead bit generating circuit 7 generates the overhead bits based on three kinds of bit pattern as shown in FIG. 4A to FIG. 4C, the bit patterns that may be used are not limited to these three kinds, and two bit patterns or four or more may also be used. Also, in the above described embodiment, the logical addition circuit takes the first bit of the pixel drive data GD (the bit number (bit digit) corresponding to the subfield $SF_1$) and adds it to the overhead bit CB in the logical addition, this is not the restriction. So long as the bit digit corresponds to a subfield with a small weighting, then the logical addition circuit may take that bit.

In the above described embodiment the logical addition of the first bit of the pixel drive data GD and the overhead bit CB is carried out regularly within the subfield $SF_1$ of each field, but the logical addition may only be carried out in response to instructions from the user. It is also possible to carry out this logical addition only when a video signal of brightness level 0 (i.e., black display) across the whole screen is entered for more than a predetermined period of time. In this case, the light emission drive control circuit 1 supplies an operational execution signal at logic level 1 to the logical addition circuit 6 when a video image signal of brightness level 0 representing a black display is inputted for a predetermined period of time or longer, and supplies an operational execution signal at logic level 0 to the logical addition circuit 6 when this is not the case. So long as the logical addition circuit 6 receives the operation execution signal of logic level 0, the logical addition circuit 6 transfers the pixel drive data GD, which it has received from the pixel drive data generating circuit 5, unchanged to the memory 8 as the pixel drive data GDD. When the logical addition circuit 6 receives the operation execution signal of logic level 1, on the other hand, the logical addition circuit 6 carries out the logical addition of the first bit of the pixel drive data GD and the overhead bit CB, and supplies to the memory 8 the pixel drive data GDD that has the result of this operation as its new first bit.

In short, only when a video image signal of brightness level 0 corresponding to a black display is inputted constantly for a predetermined period of time or longer, some pixel cells chosen at random from among the entire pixel cells are forcibly set to the light-emitting mode during the address process of a subfield with a small weighting. By carrying out the random selection for every k fields (where k is an integer no less than 1), all the pixel cells are set at least once to the light emitting mode within a range of M·k fields (where M is an integer no less than 2).

In the embodiment described above, the light emission drive control circuit 1 controls the light-emission of the PDP 100 according to the light-emission drive sequence shown in FIG. 2, but the light-emission drive sequence is not limited to that shown in FIG. 2.

Figure 5:
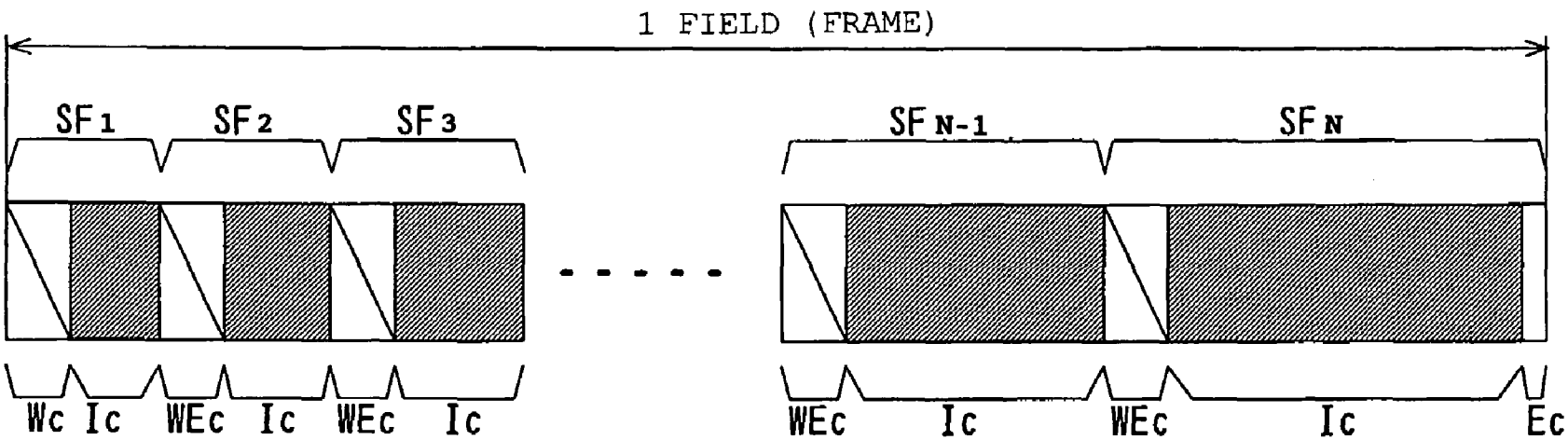
FIG. 5 shows another example of a light-emission drive sequence employed within the plasma display device shown in FIG. 1.

For example, the light-emission drive control circuit 1 may control the light emission of the PDP 100 according to the light-emission drive sequence shown in FIG. 5. This modification will be described below.

Within the light-emission drive sequence shown in FIG. 5, the sustain process Ic is carried out for each of the subfields $SF_1$-$SF_N$ in the same way as the light-emission drive sequence shown in FIG. 2. In the light-emission drive sequence shown in FIG. 5, the selective-writing address process Wc is carried out within the leading subfield $SF_1$ prior to the sustain process Ic in the same way as in the light-emission drive sequence shown in FIG. 2, but in all the further subfields $SF_2$-$SF_N$, a selective-elimination address process WEc is carried out instead. Within this selective-elimination address process WEc, the Y-electrode driver 2 applies a scanning pulse sequentially to each of the row electrodes $Y_1$-$Y_n$ of the PDP 100. Meanwhile, the address data driver 4 generates m pixel data pulses $DP_1$-$DP_m$ having voltage values corresponding to the logic levels of the m pixel drive data bits DB supplied from the memory 8. The m pixel drive data bits DB are the data bits necessary for one display line. The address data driver 4 then applies the m pixel data pulses $DP_1$-$DP_m$ to the column electrodes $D_1$-$D_m$ of the PDP 100 respectively. For example, the address data driver 4 generates a pixel data pulse DP of a predetermined high voltage when the pixel drive data bit DB is at logic level 1, and generates a pixel data pulse DP of low voltage (0 volts) when the pixel drive data bit DB is at a logic level 0. Thus, discharge (referred to as selective-elimination discharge) selectively takes place only in those pixel cells to which the scanning pulse SP is applied and the high-voltage pixel data pulse DP is applied, so that the wall charge left behind within these pixel cells is eliminated. However, in pixel cells to which the scanning pulse SP is applied and the low-voltage pixel data pulse DP is applied, the selective-elimination discharge does not take place, so that the wall charge within the pixel cells remains unchanged. In this case, those cells in which a wall voltage of a specified volume remains are set to the 'light-emitting mode', and those cells in which the wall charge has been eliminated are set to the 'lights out mode'.

Within the light-emitting drive sequence shown in FIG. 5, the elimination process Ec takes place after the sustain process Ic only in the final subfield $SF_N$.

When controlling the light emission of the PDP 100 according to the light emission drive sequence shown in FIG. 5, in accordance with the brightness levels of the input image signal, the pixel drive data generating circuit 5 can generate N-bit pixel drive data GD in N+1 different ways as shown in FIG. 6 and provide them to the logical addition circuit 6.

Thus, by means of driving based on the N+1 pixel drive data GD as shown in FIG. 6, selective-writing address discharge for one display line takes place within each display cell during the selective writing address process Wc of the leading subfield $SF_1$ (shown by the double circles in the figure) display line by display line, except when expressing a brightness level 0 (first gradation). By means of this, the desired amount of wall charge is provided within each pixel cell for one display line at a time, and all the pixel cells are set to the light-emitting mode. Then, in response to the brightness level represented by the pixel drive data GD, selective-elimination address discharge (shown by black circles in the figure) takes place in one subfield of the subfields $SF_2$-$SF_N$, except when expressing the highest brightness level (gradation N+1). By means of this selective elimination address discharge, the wall charge remaining inside a pixel cell is eliminated, and the pixel cell is set to the lights out mode. That is to say, each pixel cell is set to the light-emitting mode only within a series of subfields SF corresponding to the intermediate brightness level that is to be represented, and sustain discharge (shown by the white circles in the figure) is carried out according to the number of repetitions assigned to each of those subfields. A brightness level is then perceived corresponding to the total number of light emissions accompanying the sustain discharge produced within one field (frame). As a result, by means of N+1 light-emitting patterns according to grayscale driving from gradation 1 to gradation N+1 shown in FIG. 6, N+1 intermediate brightness can be represented corresponding to the total number of sustain discharge (white circles) in the subfields.

Figure 7:
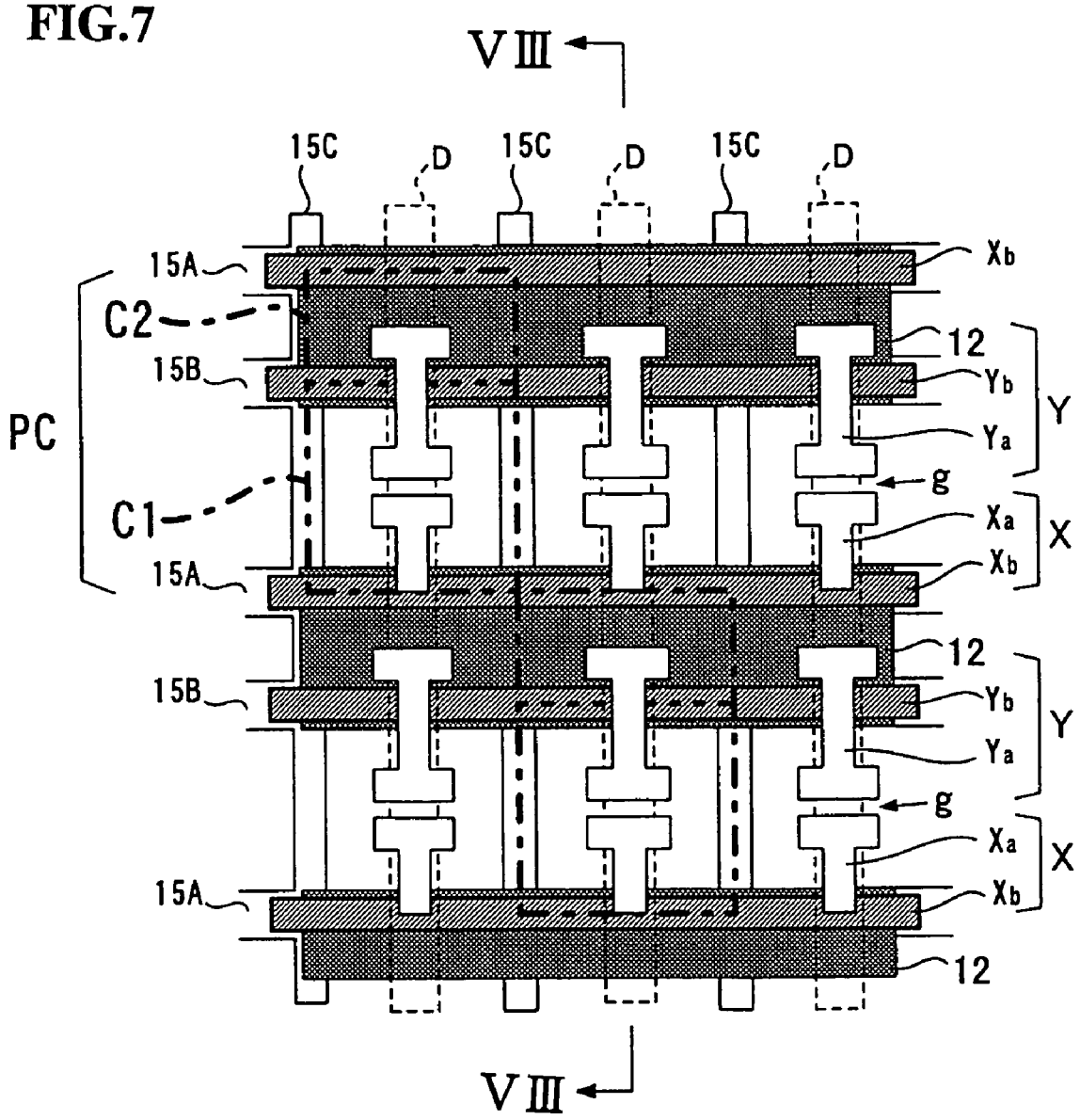
FIG. 7 is a plan view showing the structure of a pixel cell.
Figure 8:
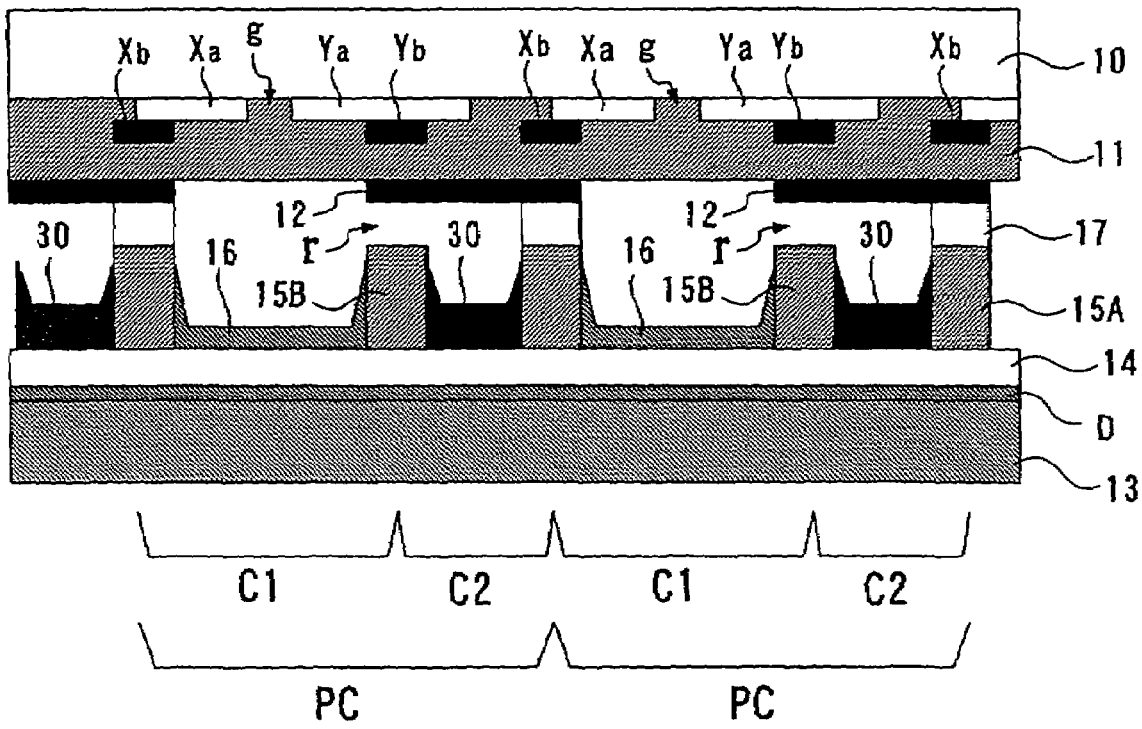
FIG. 8 is a cross-sectional view of the pixel cell taken along the line VIII-VIII in FIG. 7.

The structure shown in FIG. 7 and FIG. 8 may be employed for the pixel cells of the PDP 100. FIG. 7 is a plan view, showing a part of the internal structure of the PDP 100 as seen from the display face side; FIG. 8 is a cross-sectional view taken along the line VIII-VIII in FIG. 7.

As shown in FIG. 7, each row electrode Y is made up of a band-shaped bus electrode Yb (the main part of the row electrode Y) that extends in the row direction (left-right) of the display screen surface, and a plurality of transparent electrodes Ya connected to the bus electrode Yb. The bus electrode Yb is made of a black metallic film, for example. The transparent electrodes Ya are made from a transparent conductive film such as ITO, and are arranged in positions corresponding to the column electrodes D on top of the bus electrode Yb. The transparent electrodes Ya extend perpendicularly from the bus electrode Yb, and have two broad-shaped ends, as shown in FIG. 7. The transparent electrodes Ya thus act as protruding electrodes that protrude from the main body of the row electrode Y. Each row electrode X includes a band-shaped bus electrode Xb (the main body of the row electrode X) that extends in the row direction of the display screen, and a plurality of transparent electrodes Xa joined to the bus electrode Xb. The bus electrode Xb is a black metallic film, for example. Each transparent electrode Xa is made up of a transparent conductive film such as ITO, and is arranged on top of the bus electrode Xb in a position corresponding to each column electrode D. Each transparent electrode Xa extends at right angles from the bus electrode Xb, and has a single broad-shaped end, as shown in FIG. 7. That is to say, the transparent electrodes Xa are protruding electrodes protruding from the main body of the row column electrode X. The broad ends of the neighboring transparent electrodes Xa and Ya are arranged opposite one another with a discharge gap g of a specified length between them, as shown in FIG. 7. In other words, the protruding electrodes formed by the transparent electrodes Xa and Ya that protrude from the main bodies of the paired X and Y electrodes are arranged opposite one another with a predetermined discharge gap g. The row electrodes Y including the transparent electrodes Ya and the bus electrodes Yb and the row electrodes X including the transparent electrodes Xa and the bus electrodes Xb are arranged on the inner face of the front transparent substrate 10 (display surface) of the PDP 100, as shown in FIG. 8. A dielectric layer 11 is provided on the back face of the front transparent substrate 10, so as to cover the row electrodes X and Y. In a position corresponding to each of selection cells C2 (described below) on the surface of the dielectric layer 11, an overlay dielectric layer 12 is provided that protrudes from the dielectric layer 11 towards the rear (downwards in the drawing). The overlay dielectric layer 12 includes a band-shaped light-absorbent layer having black or dark-colored pigment, and extends in the row direction (left-right) of the display screen as shown in FIG. 7. The surface of the overlay dielectric layer 12 and the surface of the dielectric layer 11 that is not provided with the overlay dielectric layer 12, are covered with a protective layer (not shown) made from MgO (magnesium oxide). On top of the rear substrate 13, which extends in parallel to the front transparent substrate 10, a plurality of column electrodes D are arranged with a specified interval between them. The column electrodes D extend in a direction that intersects at right angles with the bus electrodes Xb and Yb. On the rear substrate 13, a white column-electrode protective layer (dielectric layer) 14 is provided that covers the column electrodes D. On top of the column-electrode protective layer 14, a partition 15 is provided which includes first side walls 15A, second side walls 15B, and vertical walls 15C. The first side walls 15A extend in the row direction of the display screen in positions on top of the column-electrode protective layer 14 opposite the bus electrodes Yb. The second side walls 15B extend in the row direction of the display screen on top of the column-electrode protective layer 14 opposite to the bus electrodes Xb. The vertical walls 15C are provided in positions between the transparent electrodes Xa (Ya) joined at regular intervals on top of the bus electrodes Xb (Yb) and extend so as to intersect the bus electrodes Xb (Yb) perpendicularly. As shown in FIG. 8, a layer of secondary electron releasing material 30 is provided within each area opposite the overlay dielectric layer 12 on top of the column-electrode protection layer 14 (including the side faces of the vertical wall 15C, the first side wall 15A, and the second side wall 15B). This secondary electron release material layer 30 is made from a material having a high secondary electron emission coefficient (high γ-value) with low work function (for example, below 4.2 eV). Materials that may be used for the secondary electron release material layer 30 include alkaline earth metal oxides such as MgO, CaO, SrO, BaO, alkaline metal oxides such as $Cs_2O$, fluorides such as $CaF_2$ or $MgF_2$, $TiO_2$, $Y_2O_3$, other materials whose secondary electron emission coefficient has been raised owing to crystal defects or impurity dopants, diamond like thin film, or a carbon nanotube. In areas other than that opposite the overlay dielectric layer 12 on the top of the column-electrode protective layer 14 (including the side faces of the vertical wall 15C, the first side wall 15A, and the second side wall 15B), a fluorescent layer 16 is provided as shown in FIG. 8. One of three types of layer forms the fluorescent substrate 16. Specifically, a red fluorescent layer that emits red light, a green fluorescent layer that emits green light, or a blue fluorescent layer that emits blue light is used for the fluorescent substrate 16. The allocations of the three types of fluorescent layers are decided depending on the locations of the pixel cells PC. Three pixel cells (namely, red, green and blue pixel cells) define in combination a single pixel. A discharge space exists between the secondary electron release material layer 30, the fluorescent substrate 16, and the dielectric layer 11. Discharge gas is filled and sealed in the discharge space. The heights of the first side walls 15A, the second side walls 15B, and the vertical walls 15C, as shown in FIG. 8, are not sufficient to reach the surface of the overlay dielectric layer 12 or the dielectric layer 11. Consequently, a space r exists between the second side walls 15B and the overlay dielectric layer 12, where the discharge gas can circulate. In the space between each first side wall 15A and the overlay dielectric layer 12 a dielectric layer 17 is provided that extends in the same direction as the first side wall 15A in order to prevent interference with discharge. Each area surrounded by the two adjacent first side wall 15A and two adjacent vertical wall 15C (the rectangular area in FIG. 7 surrounded by a single dotted line) becomes the pixel cell PC that serves the pixel. As shown in FIG. 7 and FIG. 8, each pixel cell PC is divided into a display cell C1 and a selection cell C2 by the second side wall 15B. The display cell C1 includes a pair of row electrodes X and Y that define a display line and a fluorescent substrate 16. The selection cell C2 includes the row electrode Y within the row electrode pair that defines the display line, a row electrode X within another row electrode pair that defines an immediately upper display line on the display screen, the overlay dielectric layer 12, and the secondary electron releasing material layer 30. It should be noted that within the display cell Cl, as shown in FIG. 7, the broad-shaped part at one end of the transparent electrode Xa of the row electrode X and the broad part at one end of the transparent electrode Ya of the row electrode Y are arranged facing one another with a discharge gap g in between them. Within the selection cell C2, on the other hand, the broad-shaped part at the other end of the transparent electrode Ya is included, but the transparent electrode X is not included. As shown in FIG. 8, the discharge spaces of adjacent pixel cells PC in a vertical direction of the display screen (left-right in FIG. 8) are insulated from one another by the first side wall 15A and the dielectric layer 17. The discharge spaces of a display cell C1 and a selection cell C2 belonging to the same pixel cell PC are connected by the space r, as shown in FIG. 8. In this way, each pixel cell PC includes a display cell C1 and a selection cell C2 whose respective discharge spaces are connected to one another.

This application is based on a Japanese Patent Application No. 2004-63930 filed on Mar. 8, 2004, and the entire disclosure thereof is incorporated herein by reference.

What is claimed is:

1. A method for driving a display panel based on each of a plurality of subfields which define each field of an input image signal, such that the display panel carries out grayscale display, the display panel having a plurality of pixel cells which serve as pixels, the plurality of pixel cells being arranged in a matrix pattern, each said subfield having its own weighting, wherein:

each said subfield includes an address process for setting each said pixel cell within each said subfield to either light-emitting mode or lights out mode based on the input image signal; and a sustain process for causing only those pixel cells which are set to said light-emitting mode to emit light for a period corresponding to the weighting of each said subfield, and wherein some pixel cells selected at random from among said plurality of pixel cells are forcibly set to said light-emitting mode during said address process of said subfield having a small weighting only when said input image signal continues to indicate a black display for a predetermined period of time.

2. The method for driving a display panel according to claim 1, wherein all said plurality of pixel cells are set to said light-emitting mode at least once within M·k fields (where M is an integer no less than 2) by changing said randomly selected pixel cells for every k fields (where k is an integer no less than 1).

3. The method for driving a display panel according to claim 1, wherein the subfield having the small weighting is the subfield to which the shortest light-emitting period is allocated during said sustain process, of said plurality of subfields.

4. A method for driving a display panel based on each of a plurality of subfields which define each field of an input image signal, such that the display panel carries out grayscale display, the display panel having a plurality of pixel cells which serve as pixels and are arranged in a matrix pattern, said each subfield having its own weighting, wherein:

each said subfield includes an address process for setting each said pixel cell to either a light-emitting mode or a lights out mode in accordance with a logic level of the pixel data of each pixel derived from said input image signal at a bit digit corresponding to said subfield; and a sustain process for causing only those pixel cells set to said light-emitting mode to emit light for a period of time corresponding to the weighting of said subfield, and wherein a result of a logical addition of a data bit of said pixel data at a bit digit corresponding to the subfield having small weighting and an overhead bit having a logic level to set those pixel cells randomly selected from among said plurality of pixel cells to said light-emitting mode is made a new data bit of said pixel data at said bit digit.

5. The method for driving a display panel according to claim 4, wherein all said plurality of pixel cells are set to said light-emitting mode at least once within M·k fields (where M is an integer no less than 2) by changing said randomly selected pixel cells for every k fields (where k is an integer no less than 1).

6. The method for driving a display panel according to claim 4, wherein the subfield having the small weighting is the subfield to which the shortest light-emitting period is allocated during said sustain process, of said plurality of subfields.

7. A device for driving a display panel based on each subfield of a plurality of subfields which define each field of an input image signal, so as to carry out grayscale display, the display panel having a plurality of pixel cells arranged in a matrix pattern such that the plurality of pixel cells serve as pixels, each said subfield having its-own weighting, the device comprising:

an address circuit for setting each said pixel cell to either a light-emitting mode or a lights out mode based on the input image signal in each said subfield; and a sustain circuit for causing only those pixel cells set to said light-emitting mode to emit light for a period corresponding to the weighting of said subfield, wherein, in the subfield having a small weighting among said plurality of subfields, some pixel cells selected at random from among said plurality of pixel cells are forcibly set to said light-emitting mode by said address circuit only when said input image signal continues to indicate a black display for a predetermined period of time.

8. The device for driving a display panel according to claim 7, wherein said address circuit sets all said plurality of pixel cells to said light-emitting mode at least once within M·k fields (where M is an integer no less than 2), by changing said randomly selected pixel cells for every k fields (where k is an integer no less than 1).

9. The device for driving a display panel according to claim 7, wherein the subfield having the small weighting is the subfield to which is allocated the shortest light-emitting period of all said plurality of subfields.

10. A device for driving a display panel based on each subfield of a plurality of subfields which define each field of an input image signal, so as to carry out grayscale display, the display panel having a plurality of pixel cells arranged in a matrix pattern such that the plurality of pixel cells serve as pixels, each said subfield having its own weighting, the device comprising:

an address circuit for setting each said pixel cell to either a light-emitting mode or a lights out mode based on said input image signal within each said subfield;

a sustain circuit for causing only those pixels cells set to said light-emitting mode to emit light for a period corresponding to the weighting of said subfield;

an overhead bit generator for generating an overhead bit having a logic level to set to said light-emitting mode the pixel cells selected at random from among said plurality of pixel cells; and a logical adder for making a result of a logical addition of a data bit of said pixel data at the bit digit corresponding to the subfield having a small weighting and said overhead bit, a new data bit of said pixel data at said bit digit.

11. The device for driving a display panel according to claim 10, wherein said overhead bit generator sets all said plurality of pixel cells to said light-emitting mode at least once within M·k fields (where M is an integer no less than 2), by changing said randomly selected pixel cells for every k fields (where k is an integer no less than 1).

12. The device for driving a display panel according to claim 10, wherein the subfield having the small weighting is the subfield to which the shortest light-emitting period is allocated of all said plurality of subfields.

* * * * *